US008417170B2

(12) United States Patent
Kimura

(10) Patent No.: US 8,417,170 B2
(45) Date of Patent: Apr. 9, 2013

(54) FIXING DEVICE AND IMAGE FORMING APPARATUS

(75) Inventor: Taku Kimura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 220 days.

(21) Appl. No.: 12/948,074

(22) Filed: Nov. 17, 2010

(65) Prior Publication Data

US 2011/0123238 A1 May 26, 2011

(30) Foreign Application Priority Data

Nov. 24, 2009 (JP) ..... 2009-266172

(51) Int. Cl.
*G03G 15/20* (2006.01)

(52) U.S. Cl.
USPC ..... 399/329

(58) Field of Classification Search ..... 399/122, 399/320, 328, 329, 336; 219/216
See application file for complete search history.

(56) References Cited

U.S. PATENT DOCUMENTS

| | | | | |
|---|---|---|---|---|
| 2003/0196999 | A1* | 10/2003 | Kato et al. | 219/216 |
| 2005/0035106 | A1* | 2/2005 | Sanpei et al. | 219/216 |
| 2007/0280757 | A1* | 12/2007 | Kimura | 399/329 |
| 2008/0199231 | A1* | 8/2008 | Lee et al. | 399/329 |
| 2009/0136274 | A1* | 5/2009 | Kobayashi | 399/329 |
| 2009/0263169 | A1* | 10/2009 | Kimura | 399/329 |

FOREIGN PATENT DOCUMENTS

| | | |
|---|---|---|
| JP | 2007-322888 | 12/2007 |

* cited by examiner

*Primary Examiner* — David Gray
*Assistant Examiner* — Thomas Giampaolo, II
(74) *Attorney, Agent, or Firm* — Kubotera & Associates, LLC

(57) ABSTRACT

A fixing device includes a fixing belt in an endless shape for fixing developer to a printing medium; a supporting member for contacting with and supporting the fixing belt; a heating member for contacting with and heating the fixing belt supported with the supporting member; and a heat regulating member disposed between the supporting member and the heating member.

24 Claims, 9 Drawing Sheets

FIXING DEVICE AND IMAGE FORMING APPARATUS

BACKGROUND OF THE INVENTION AND RELATED ART STATEMENT

The present invention relates to an image forming apparatus such as a printer and a copier, and to a fixing device disposed in the image forming apparatus.

In a conventional fixing device disposed in an image forming apparatus such as a printer, a fixing belt in an endless shape is extended between two opposite pressing rollers, so that the fixing belt rotates and moves while a heating member heats the fixing belt. Accordingly, it is possible to transfer developer such as toner formed of charged fine particles to a printing medium at a high speed with low power consumption. When the printing medium passes through between the pressing rollers and contacts with the fixing belt, developer is fixed to the printing medium.

Patent Reference has disclosed such a conventional fixing device. The conventional fixing device includes a first pressing roller, a second pressing roller, and a plane heating member. The first pressing roller is provided for pressing the printing medium through the fixing belt. The second pressing roller is disposed to face the first pressing roller for contacting with an outer circumferential surface of the fixing belt to form a nip region (a contacting surface where the pressing rollers are pressed against each other), thereby pressing the printing medium. The plane heating member is arranged to contact with the fixing belt at an upstream side of the nip region in a moving direction of the fixing belt for heating the fixing belt.

Patent Reference: Japanese Patent Publication No. 2007-322888

In the conventional fixing device disclosed in Patent Reference, the plane heating member includes an electrode connected to a power source at an end portion of a main body thereof for receiving a voltage. Further, the plane heating member is attached to a supporting member, and has an identical resistivity as a whole. When the power source applies a constant voltage to the plane heating member, the plane heating member is uniformly heated up.

In the conventional fixing device disclosed in Patent Reference, an end portion of the plane heating member tends to dissipate heat to surrounding to a greater extent than a middle portion of the plane heating member. Accordingly, even when an entire body of the plane heating member is uniformly heated up, a temperature at an edge portion of the fixing belt tends to be lower than that at a middle portion of the fixing belt when the plane heating member heats the fixing belt.

In particular, the plane heating member tends to dissipate heat through the supporting member. As a result, the printing medium tends to have a temperature distribution, so that it is difficult to uniformly fix developer to the printing medium, thereby causing a fixing variation spot of developer on the printing medium. When developer is pressed and fixed to the printing medium, if developer is heated insufficiently, developer is not completely melt. Accordingly, a part of developer may stick to the fixing belt, thereby causing phenomenon called cold offset.

In view of the problems described above, an object of the present invention is to provide a fixing device and an image forming apparatus capable of solving the problems of the conventional fixing device. In the present invention, it is possible to prevent cold offset on a side edge of a printing medium, and to uniformly fix developer to the printing medium.

Further objects and advantages of the invention will be apparent from the following description of the invention.

SUMMARY OF THE INVENTION

In order to attain the objects described above, according to the present invention, a fixing device includes a fixing belt in an endless shape for fixing developer to a printing medium; a supporting member for contacting with and supporting the fixing belt; a heating member for contacting with and heating the fixing belt supported with the supporting member; and a heat regulating member disposed between the supporting member and the heating member.

In the present invention, the heat regulating member is provided for obtaining a uniform heat distribution, and transferring heat to the fixing belt. Accordingly, it is possible to reduce cold offset generated at both side edges of the printing medium. Further, it is possible to uniformly fix developer to the printing medium, thereby reducing a fixing variation spot of developer.

BRIEF DESCRIPTION OF THE DRAWINGS

FIG. 2(*b*) is a schematic sectional view showing a partial configuration of the image forming apparatus including the fixing device according to the first embodiment of the present invention;

FIG. 4(*b*) is a schematic sectional view showing a modified example of the fixing roller of the fixing device according to the first embodiment of the present invention;

FIG. 6(*b*) is a schematic perspective view showing a modified example of the plane heating member of the fixing device according to the first embodiment of the present invention;

FIG. 9(*b*) is a schematic enlarged perspective view showing a modified example of the fixing belt of the fixing device according to the first embodiment of the present invention;

DETAILED DESCRIPTION OF PREFERRED EMBODIMENTS

Hereunder, embodiments of the present invention will be explained with reference to the accompanying drawings. In the following description, a printer P will be explained as an image forming apparatus.

First Embodiment

Figure 2A:
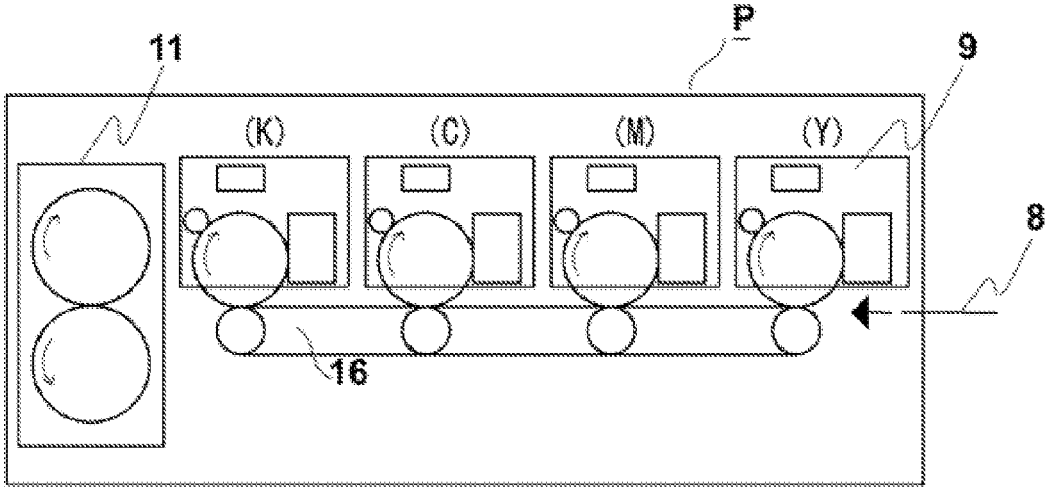
FIG. 2(*a*) is a schematic sectional view showing an entire configuration of an image forming apparatus including the fixing device according to the first embodiment of the present invention.
Figure 2B:
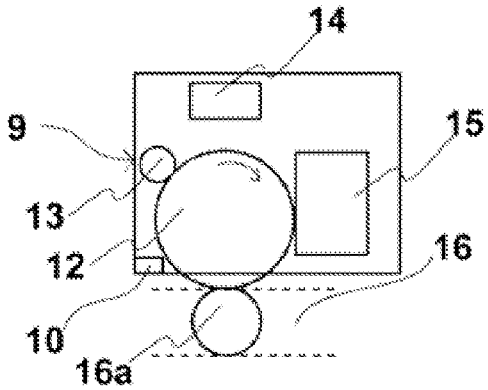

A first embodiment of the present invention will be explained. FIG. 2(*a*) is a schematic sectional view showing an entire configuration of the printer P including a fixing device 11 according to the first embodiment of the present invention. FIG. 2(*b*) is a schematic sectional view showing a partial configuration of the printer P including the fixing device 11 according to the first embodiment of the present invention.

As shown in FIG. 2(*a*), the printer P includes image forming units 9 for forming images in black (K), cyan (C), magenta (M), and yellow (Y); a transportation unit 16 having transfer rollers 16*a* corresponding to the image forming units 9 and a belt in an endless shape disposed below the image forming units 9 for transporting a printing medium 8; and the fixing device 11 having a fixing roller 1 and a pressing roller 5 facing each other for heating and pressing the printing medium 8, so that developer (toner) 7 (refer to FIG. 3) is fixed to the printing medium 8.

As shown in FIG. 2(*b*), each of the image forming units 9 includes a charging roller 13 for uniformly charging a surface of a photosensitive drum 12; an exposure unit 14 for irradiating the surface of the photosensitive drum 12 with an LED (Light Emitting Diode) for forming a static latent image thereon; a developing unit 15 having a developing roller, a toner tank, a toner supplying sponge roller, and the like; and a cleaning blade 10 for removing the toner 7 after transfer.

Figure 3:
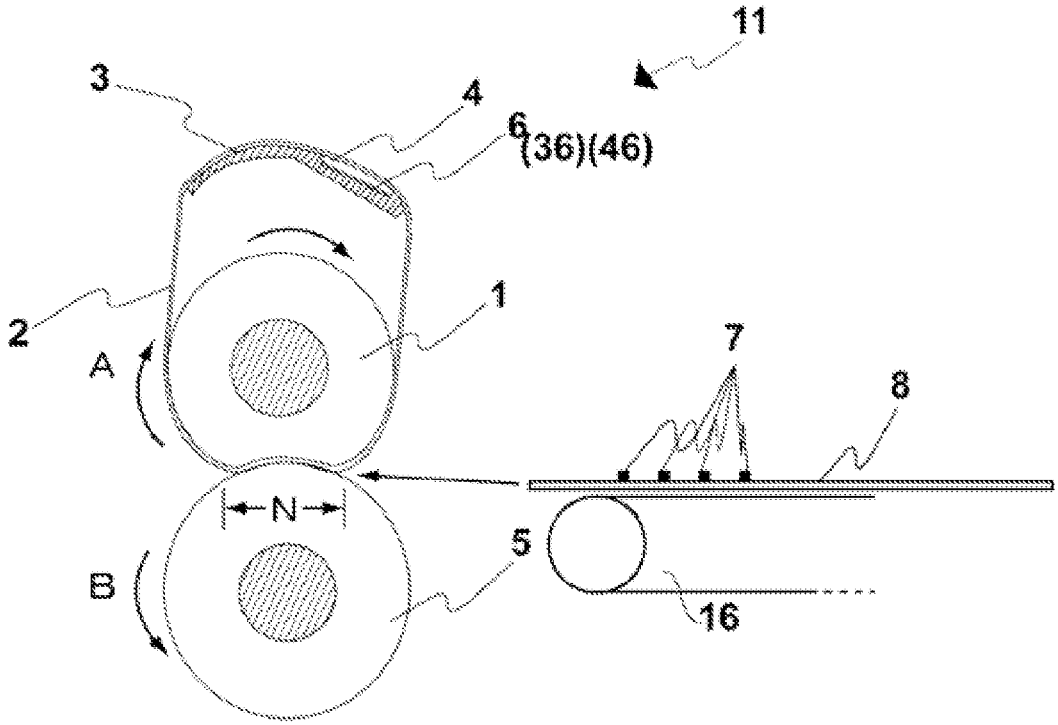
FIG. 3 is a schematic side view showing the fixing device according to the first embodiment of the present invention.

FIG. 3 is a schematic side view showing the fixing device 11 according to the first embodiment of the present invention. As shown in FIG. 3, the fixing device 11 includes the fixing roller 1, the pressing roller 5 disposed to face the fixing roller 1; and a fixing belt 2 extended between the fixing roller 1 and a supporting member 3. In the fixing device 11, when the transportation unit 16 transports the printing medium 8 with the toner 7 still not fixed, the fixing belt 2 and the pressing roller 5 rotate and sandwich the printing medium 8 to heat and press the printing medium 8, so that the toner 7 is fixed to the printing medium 8.

Figure 4A:
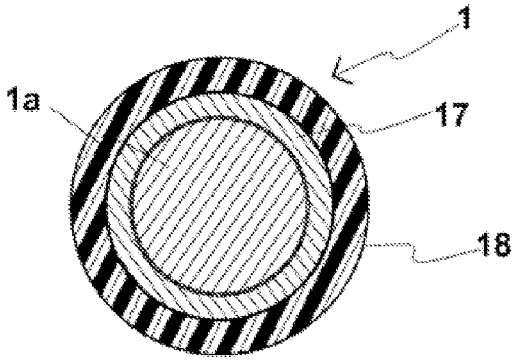
FIG. 4(*a*) is a schematic sectional view showing a fixing roller of the fixing device according to the first embodiment of the present invention.
Figure 4B:
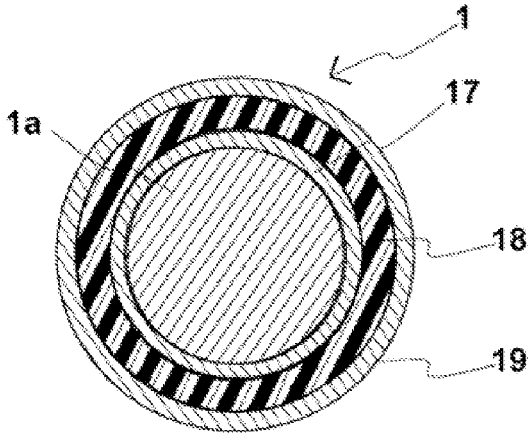

FIG. 4(*a*) is a schematic sectional view showing the fixing roller 1 of the fixing device 11 according to the first embodiment of the present invention. As shown in FIG. 4(*a*), the fixing roller 1 includes a metal core 17 in a drum shape fitted to a rotational shaft 1*a* and an elastic layer 18 in a drum shape disposed on an outer circumferential surface of the core metal 17. The core metal 17 is formed of a metal pipe of aluminum, iron, stainless steel, and the like having specific rigidity. The elastic layer 18 is normally formed of a rubber material with high heat resistance such as a silicone rubber or a fluorine rubber.

FIG. 4(*b*) is a schematic sectional view showing a modified example of the fixing roller 1 of the fixing device 11 according to the first embodiment of the present invention. As shown in FIG. 4(*b*), as the modified example, a releasing layer 19 may be disposed on the elastic layer 18 for easily releasing from the fixing belt 2.

As shown in FIG. 3, the fixing roller 1 is pressed against the pressing roller 5 with the fixing belt 2 extended with the supporting member 3 in between, so that a nip portion N is created between the fixing roller 1 and the pressing roller 5. Further, the fixing roller 1 is arranged to rotate in an arrow direction A.

Figure 5:
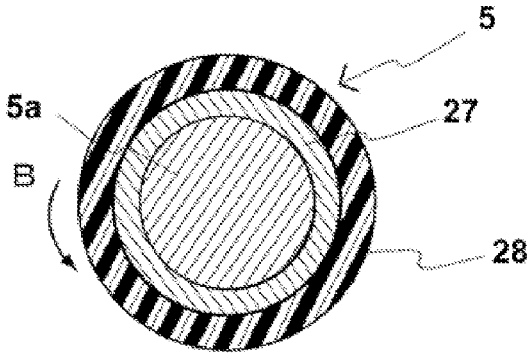
FIG. 5 is a schematic sectional view showing a pressing roller of the fixing device according to the first embodiment of the present invention.

FIG. 5 is a schematic sectional view showing the pressing roller 5 of the fixing device 11 according to the first embodiment of the present invention. As shown in FIG. 5, similar to the fixing roller 1, the pressing roller 5 includes a metal core 27 in a drum shape fitted to a rotational shaft 5*a* and an elastic layer 28 in a drum shape disposed on an outer circumferential surface of the core metal 27. The core metal 27 is formed of a metal pipe of aluminum, iron, stainless steel, and the like having specific rigidity. The elastic layer 28 is normally formed of a rubber material with high heat resistance such as a silicone rubber or a fluorine rubber. The pressing roller 5 is arranged to press against the fixing roller 1 and rotate in an arrow direction B (refer to FIG. 3).

As shown in FIG. 3, the supporting member 3 is arranged to support the fixing belt 2 extended with the fixing roller 1. The supporting member 3 is formed of a metal plate with high heat conductivity and easy processing ability, and is formed in a curved shape along the fixing roller 1 made of aluminum, copper or an alloy thereof, or a metal plate with high heat resistance and high rigidity made of iron, a metal alloy of iron, or stainless steel. Both end portions of the supporting member 3 (in a direction perpendicular to a direction that the fixing belt 2 is extended) are attached and fixed to a housing (not shown) of the fixing device 11.

In the embodiment, a plane heating member 4 is disposed in an upper curved surface of the supporting member 3, and a heat conductive portion 6 is disposed under the plane heating member 4 as a heat regulating member. The supporting member 3 is arranged to closely contact with the plane heating member 4 with the heat conductive portion 6 in between. In particular, the supporting member 3 is integrated with the plane heating member 4 and the heat conductive portion 6 as a supporting portion of the fixing belt 2, so that the fixing belt 2 slides along an upper surface of the supporting member 3 with a specific pressure when the fixing roller 1 rotates.

Figure 6A:
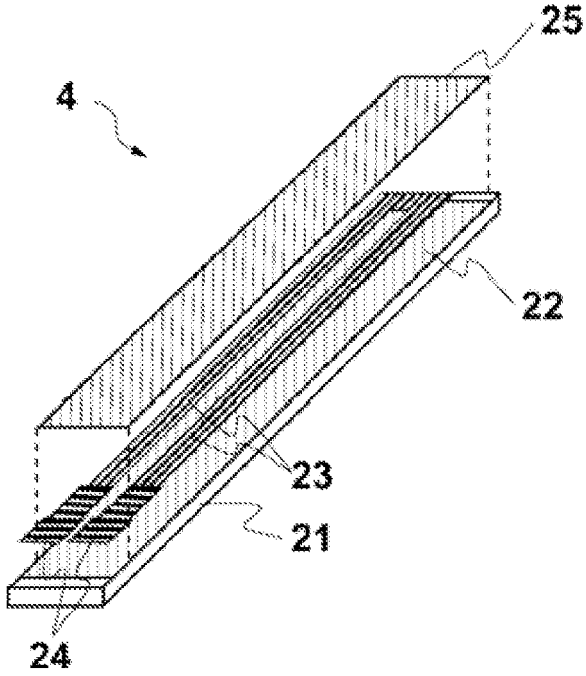
FIG. 6(*a*) is a schematic perspective view showing the plane heating member of the fixing device according to the first embodiment of the present invention.
Figure 6B:
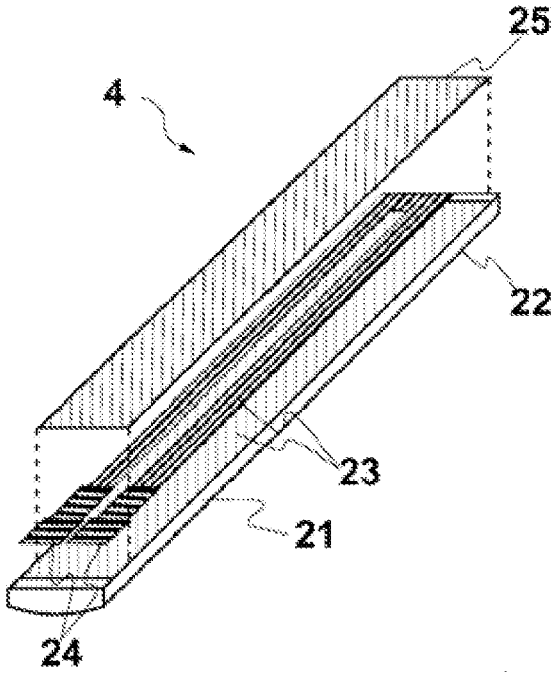

FIG. 6(*a*) is a schematic perspective view showing the plane heating member 4 of the fixing device 11 according to the first embodiment of the present invention. As shown in FIG. 6(*a*), the plane heating member 4 includes an electrically insulating layer 22 formed of a thin glass layer on a substrate 21 formed of SUS 430 (a ferrite type stainless steel). Further, a resistor heating member 23 is disposed on the electrically insulating layer 22. The resistor heating member 23 is formed of a paste material containing powders of a nickel-chromium alloy or a silver-palladium alloy through a screen printing process. Further, electrodes 24 are disposed at both end portions of the resistor heating member 23. The electrodes 24 are formed of silver with chemical stability and low electrical resistivity or tungsten with a high melting point.

Figure 7:
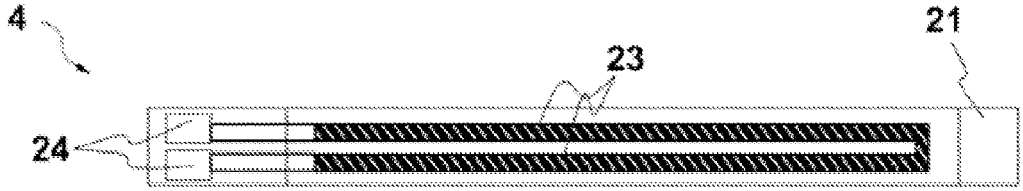
FIG. 7 is a schematic plan showing the plane heating member of the fixing device according to the first embodiment of the present invention.

FIG. 7 is a schematic plan showing the resistor heating member 23 of the plane heating member 4 of the fixing device 11 viewed from above according to the first embodiment of the present invention. When a power source (not shown) applies a voltage (at 800 W, for example) to the electrodes 24, the resistor heating member 23 is heated up.

FIG. 6(*b*) is a schematic perspective view showing a modified example of the plane heating member 4 of the fixing device 11 according to the first embodiment of the present invention. As shown in FIG. 6(*b*), a protective layer 25 is formed on an upper surface of the resistor heating member 23. The protective layer 25 is formed of glass or a typical fluorine type resin such as PTFE (polytetrafluoro-ethylene), PFA (perfluoro-alkoxy-alkane), FEP (perfluoroethylene-propene coploymer), and the like.

Further, as shown in FIG. 6(*b*), the substrate 21 has a curved surface opposite to the resistor heating member 23 and the protective layer 25. Accordingly, it is possible to arrange the plane heating member 4 such that an inner surface of the fixing belt 2 contacts with the curved surface of the substrate 21.

Figure 1:
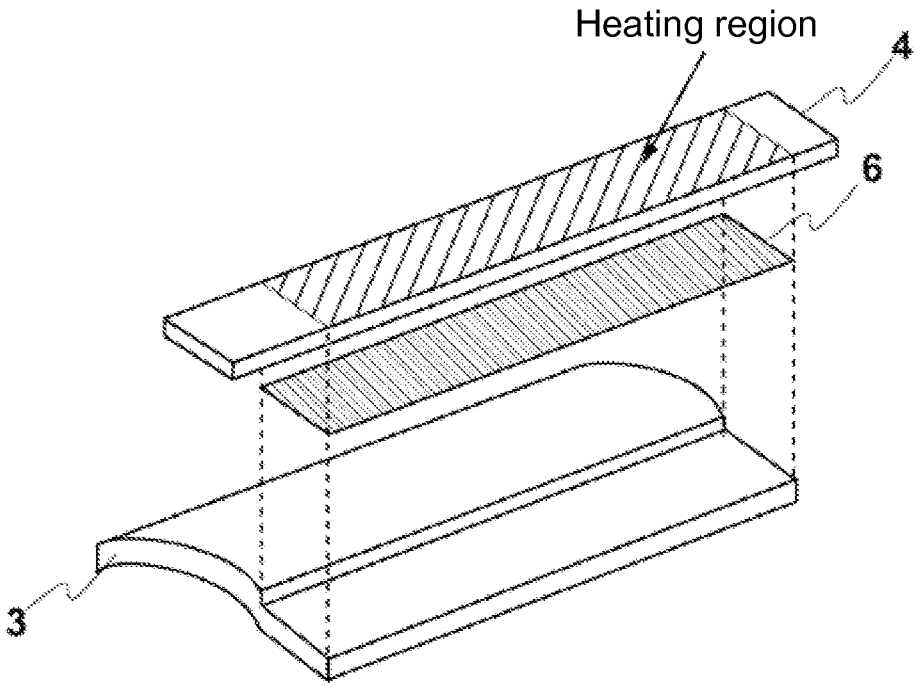
FIG. 1 is a schematic exploded perspective view showing a plane heating member and a supporting member of a fixing device according to a first embodiment of the present invention.

As shown in FIG. 1, the heat conductive portion 6 is formed of grease with high heat resistance such as a silicone type grease or a fluorine type grease, or a resin sheet with high heat resistance such as a silicone resin, polyimide, polyamideimide, a fluorine type resin, and the like. Further, a filler such as carbon black, carbon nanotube, graphite and the like, and powders of a metal such as aluminum or silver or a metal oxide may be mixed in grease to improve heat conductivity. Further, the heat conductive portion 6 may be formed of graphite in a sheet shape, or a metal sheet with a lower melting point made of tin or an alloy containing tin.

As shown in FIG. 3, the heat conductive portion 6 is arranged to fill a small gap between the supporting member 3 and the plane heating member 4. When the heat conductive portion 6 has a sheet shape, it is preferred that the heat conductive portion 6 has a thickness greater than 0.05 mm, thereby improving heat conductivity at a center portion thereof. Further, it is preferred that the heat conductive portion 6 has a thickness less than 0.5 mm, thereby decreasing thermal resistivity.

Figure 8:
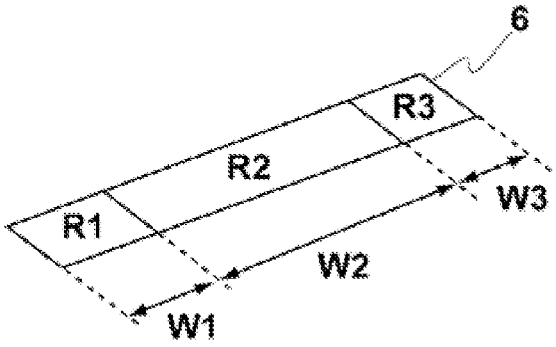
FIG. 8 is a schematic sectional view showing a heating region of a heat conductive portion of the fixing device according to the first embodiment of the present invention.

FIG. 8 is a schematic sectional view showing a heating region of the heat conductive portion 6 of the fixing device 11 according to the first embodiment of the present invention. As shown in FIG. 8, the heat conductive portion 6 has three heating regions R1, R2, and R3. The heating regions R1, R2, and R3 have widths W1, W2, and W3 to be determined according to a temperature distribution of the plane heating member 4.

In the embodiment, the heating regions R1, R2, and R3 have heat conductivity $\lambda 1$, $\lambda 2$, and $\lambda 3$, respectively. The heat conductive portion 6 is configured through adjusting a composition of a filler thereof, so that the conductivity $\lambda 1$ becomes smaller than the conductivity $\lambda 2$, and the conductivity $\lambda 2$ becomes greater than the conductivity $\lambda 3$ ($\lambda 1<\lambda 2$, $\lambda 3<\lambda 2$). Accordingly, it is possible to restrict heat of the plane heating member 4 at the both end portions thereof from flowing to the supporting member 3 through the heat conductive portion 6.

In the embodiment, when the composition of the filler is adjusted, a content of the metal powders of cupper or aluminum is adjusted with respect to a constant ratio of the filler, thereby adjusting the heat conductivity $\lambda 1$, $\lambda 2$, and $\lambda 3$. For example, when the filler contains a large amount of the metal powders, the heat conductivity is increased. When the filler contains a small amount of the metal powders, the heat conductivity is decreased. Alternatively, a content of the filler may be adjusted with respect to a constant ratio of the metal powders, thereby adjusting the heat conductivity $\lambda 1$, $\lambda 2$, and $\lambda 3$. For example, when the filler decreases, the heat conductivity is increased. When the filler increases, the heat conductivity is decreased.

Figure 9A:
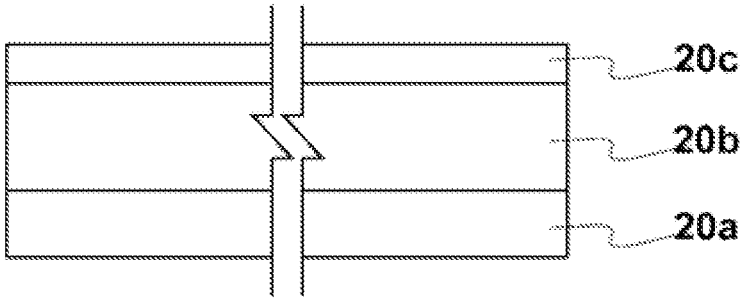
FIG. 9(*a*) is a schematic enlarged perspective view showing a fixing belt of the fixing device according to the first embodiment of the present invention.
Figure 9B:
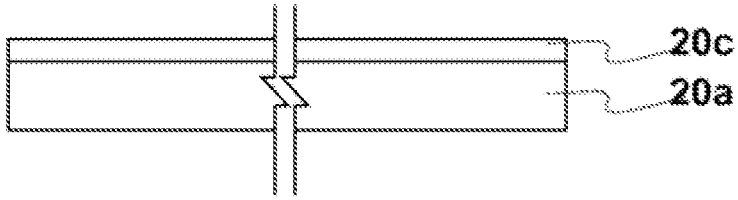

FIG. 9(*a*) is a schematic enlarged perspective view showing the fixing belt 2 of the fixing device 11 according to the first embodiment of the present invention. As shown in FIG. 9(*a*), the fixing belt 2 includes a base member 20*a* formed of a thin member of nickel, stainless steel or polyimide, and an elastic layer 20*b* formed on the base member 20*a* and formed of a silicone rubber or a fluorine type resin.

In the embodiment, the base member 20*a* has a thickness of 30 to 150 μm, so that the base member 20*a* has sufficient strength and flexibility. The elastic layer 20*b* preferably has a thickness of 50 to 300 μm, so that the elastic layer 20*b* has sufficiently low hardness and high heat conductivity. The fixing belt 2 is formed in an endless loop having a width similar to a width of the fixing roller 1 and an inner diameter of 45 mm. The fixing belt 2 is extended between the fixing roller 1 and the supporting member 3 with a specific tension.

FIG. 9(*b*) is a schematic enlarged perspective view showing a modified example of the fixing belt 2 of the fixing device 11 according to the first embodiment of the present invention. The fixing belt 2 may have a releasing layer on the elastic layer 20*b*, thereby improving releasing ability relative to the printing medium 8. Alternatively, as shown in FIG. 9(*b*), the fixing belt 2 is modified to have a releasing layer 20*c* on the base member 20*b* without the elastic layer 20*b*. In this case, the fixing belt 2 is extended between the fixing roller 1 and the supporting member 3 such that the releasing layer 20*c* faces outside.

In the embodiment, similar to the releasing layer 19 of the fixing roller 1, the releasing layer 20*c* is formed of a typical fluorine type resin with high heat resistance and low surface free energy after molding such as PTFE (polytetrafluoroethylene), PFA (perfluoro-alkoxy-alkane), FEP (perfluoroethylene-propene coploymer), and the like. The releasing layer 20*c* has a thickness of 10 to 50 μm.

In the embodiment, the toner 7 includes a binder resin such as polystyrene, a styrene-propylene copolymer, a styrene-vinyl naphthalene copolymer, a styrene-methyl acrylate copolymer, a polyester type copolymer, a polyurethane type copolymer, an epoxy type copolymer, an aliphatic or cycloaliphatic hydrocarbon resin, an aromatic type petroleum resin, and the like. The binder resin is composed of one type of resin or a mixture of resins. Further, the toner 7 contains a colorant, a releasing agent, and the like. Further, the toner 7 may contain wax such as polyethylene wax, propylene wax, carnauba wax, and various ester type waxes for preventing offset upon fixing.

An operation of the fixing device 11 will be explained next. When the transportation unit 16 transports the printing medium 8 with the toner 7 transferred thereto to the fixing device 11, as shown in FIG. 3, the fixing belt 2 of the fixing device 11 follows the movement of the transportation unit 16 and rotates in the arrow direction A at the fixing roller 1 and the pressing roller 5 while sliding against the supporting member 3 and the plane heating member 4. At this moment, the electric power of 800 W is supplied to the plane heating member 4, so that a contact portion of the fixing belt 2 relative to the plane heating member 4 is heated.

In the embodiment, a temperature detection unit (not shown) is provided for detecting a surface temperature of the fixing belt 2. Further, a control unit (not shown) is provided for controlling the electric power supplied to the plane heating member 4 according to the surface temperature of the fixing belt 2. Accordingly, it is possible to maintain the surface temperature of the fixing belt 2 at an optimal temperature (=170° C.) when the printing medium 8 is transported to the fixing device 11.

As described above, the pressing roller 5 is pressed against the fixing roller 1 with the fixing belt 2 in between, thereby forming the nip portion N. When the printing medium 8 with the toner 7 transferred thereto passes through the nip portion N between the fixing belt 2 and the pressing roller 5, the fixing belt 2 and the pressing roller 5 heat and press the toner 7 on the printing medium 8, so that the toner 7 is fixed to the printing medium 8. At this moment, heat generated with the plane heating member 4 flows to the supporting member 3 through the heating regions R1, R2, and R3 of the heat conductive portion 6.

As described above, as shown in FIG. 8, the heat conductive portion 6 has the heating regions R1, R2, and R3. Further, the heating regions R1, R2, and R3 have the heat conductivity λ1, λ2, and λ3, and the conductivity λ1 is smaller than the conductivity λ2, and the conductivity λ2 is greater than the conductivity λ3 (λ1<λ2, λ3<λ2). Accordingly, heat of the plane heating member 4 at the both end portions thereof does not easily flow (escape) to the supporting member 3 as opposed to at a center portion thereof. As a result, it is possible to prevent a temperature at the both end portions of the plane heating member 4 from decreasing, and to uniformly supply heat to the fixing belt 2, thereby preventing a fixing variation spot of the toner 7 on the printing medium 8.

An experiment was conducted for evaluating the fixing device 11. In the experiment, the fixing belt 2 had an inner diameter of 45 mm. The fixing belt 2 included the base member 20*a* formed of polyimide and having a thickness of 90 μm; the elastic layer 20*b* formed of a silicone rubber and having a thickness of 200 μm; and the releasing layer 20*c* formed of PFA and having a thickness of 30 μm.

In the experiment, the fixing roller 1 had an outer diameter of 30 mm, and included the elastic layer 18 formed of a silicone sponge and having a thickness of 8 mm. The elastic layer 18 had an ASKER C hardness of 35°. The pressing roller 5 had an outer diameter of 30 mm. The pressing roller 5 included a releasing layer formed of PFA and having a thickness of 30 μm and the elastic layer 28 formed of a silicone sponge and having a thickness of 8 mm. The elastic layer 28 had an ASKER C hardness of 35°. The pressing roller 5 was arranged to press against the fixing roller 1 with a pressing force of 12 kg.f.

In the experiment, the plane heating member 4 was formed of stainless steel, and had a width of 12 mm. The electric power of 800 W was supplied to the plane heating member 4, and the plane heating member 4 was pressed with a pressing force of 1.0 kg.f. The supporting member 3 was formed of aluminum and had a thickness of 1.5 mm. The supporting member 3 and the plane heating member 4 were arranged to contact with the fixing belt 2 with a contact length of 30 mm. The heat conductive portion 6 was formed of PTFE and had a thickness of 0.1 mm.

In the experiment, the heat conductive portion 6 contained 50% of carbon black in the heating region R1, 30% of carbon black in the heating region R2, and 50% of carbon black in the heating region R3. The heating regions R1, R2, and R3 had the widths W1 of 30 mm, W2 of 170 mm, and W3 of 30 mm, respectively.

In the experiment, the toner 7 of yellow, magenta, cyan, and black was used. The printing medium 8 had a density of 64 g/m2, and a size of A4. The printing medium 8 was transported laterally, and the toner 7 was transferred to the printing medium 8 at an amount of 1.5±0.1 g. The fixing roller 1 was pressed against the pressing roller 5 to form the nip portion N having a width of 9 mm. The fixing belt 2 rotated at a circumferential speed of 100 mm/s.

In the experiment, under the conditions described above, the toner 7 was transferred and fixed to an entire surface of the printing medium 8. Afterward, the printing medium 8 was visually inspected to detect offset at a lower left edge portion, a lower middle portion, and a lower right edge portion thereof. When offset was visible, the result was represented as NG, and when offset was visible, the result was represented as OK. Results of the experiment are shown in Table 1.

TABLE 1

| Temperature (° C.) | Location | Without heat conductive portion | With heat conductive portion |
|---|---|---|---|
| 150 | Lower left | NG | NG |
| | Middle | OK | OK |
| | Lower right | NG | NG |
| 155 | Lower left | NG | NG |
| | Middle | OK | OK |
| | Lower right | NG | NG |
| 160 | Lower left | NG | NG |
| | Middle | OK | OK |
| | Lower right | NG | NG |
| 165 | Lower left | NG | OK |
| | Middle | OK | OK |
| | Lower right | NG | OK |
| 170 | Lower left | OK | OK |
| | Middle | OK | OK |
| | Lower right | OK | OK |
| 175 | Lower left | OK | OK |
| | Middle | OK | OK |
| | Lower right | OK | OK |
| 180 | Lower left | OK | OK |
| | Middle | OK | OK |
| | Lower right | OK | OK |

As shown in Table 1, when the heat conductive portion 6 was disposed, the temperature at which offset occurred at the both edge portions of the printing medium 8 decreased by 10° C. Accordingly, it is possible to more uniformly fix the toner 7 to the printing medium 8.

Second Embodiment

A second embodiment of the present invention will be explained next. In the second embodiment, similar to the first embodiment, the printer will be explained as the image forming apparatus. Components in the second embodiment similar to those in the first embodiment are designated with the same reference numerals.

As shown in FIG. 3, the fixing device 11 includes the fixing roller 1, the pressing roller 5 disposed to face the fixing roller 1; and the fixing belt 2 extended between the fixing roller 1 and the supporting member 3. In the fixing device 11, when the transportation unit 16 transports the printing medium 8 with the toner 7 still not fixed, the fixing belt 2 and the pressing roller 5 each rotating sandwich the printing medium 8 to heat and press the printing medium 8, so that the toner 7 is fixed to the printing medium 8.

As shown in FIG. 4(*a*), the fixing roller 1 includes the metal core 17 in a drum shape fitted to the rotational shaft 1*a* and the elastic layer 18 in a drum shape disposed on the outer circumferential surface of the core metal 17. The core metal 17 is formed of a metal pipe of aluminum, iron, stainless steel, and the like having specific rigidity. The elastic layer 18 is formed of a rubber material with high heat resistance such as a silicone rubber or a fluorine rubber.

As shown in FIG. 4(*b*), as the modified example, the releasing layer 19 may be disposed on the elastic layer 18 for easily releasing from the fixing belt 2. The fixing roller 1 is pressed against the pressing roller 5 with the fixing belt 2 extended with the supporting member 3 in between, so that the nip portion N is created between the fixing roller 1 and the pressing roller 5. Further, the fixing roller 1 is arranged to rotate in the arrow direction A (refer to FIG. 3).

As shown in FIG. 5, similar to the fixing roller 1, the pressing roller 5 includes the metal core 27 in a drum shape fitted to the rotational shaft 5*a* and the elastic layer 28 in a drum shape disposed on the outer circumferential surface of the core metal 27. The core metal 27 is formed of a metal pipe of aluminum, iron, stainless steel, and the like having specific rigidity. The elastic layer 28 is normally formed of a rubber material with high heat resistance such as a silicone rubber or a fluorine rubber. The pressing roller 5 is arranged to press against the fixing roller 1 and rotate in the arrow direction B (refer to FIG. 3).

As shown in FIG. 3, the supporting member 3 is arranged to support the fixing belt 2 extended with the fixing roller 1. The supporting member 3 is formed of a metal plate with high heat conductivity and easy processing ability, and is formed in a curved shape along the fixing roller 1 made of aluminum, copper or an alloy thereof, or a metal plate with high heat resistance and high rigidity made of iron, a metal alloy of iron, or stainless steel. The both end portions of the supporting member 3 (in the direction perpendicular to the direction that the fixing belt 2 is extended) are attached and fixed to the housing (not shown) of the fixing device 11.

In the embodiment, the plane heating member 4 is disposed in the upper curved surface of the supporting member 3, and a heat conductive portion 36 is disposed under the plane heating member 4 as a heat regulating member. Further, an auxiliary heat conductive portion 26 is disposed under the heat conductive portion 36 (refer to FIG. 10). The supporting member 3 is arranged to closely contact with the plane heating member 4 with the heat conductive portion 36 and the auxiliary heat conductive portion 26 in between. In particular, the supporting member 3 is integrated with the plane heating member 4, the heat conductive portion 36 and the auxiliary heat conductive portion 26 as a supporting portion of the fixing belt 2, so that the fixing belt 2 slides along the upper surface of the supporting member 3 with a specific pressure when the fixing roller 1 rotates.

As shown in FIG. 6(*a*), the plane heating member 4 includes the electrically insulating layer 22 formed of a thin glass layer on the substrate 21 formed of SUS 430 (a ferrite type stainless steel). Further, the resistor heating member 23 is disposed on the electrically insulating layer 22. The resistor heating member 23 is formed of a paste material containing powders of a nickel-chromium alloy or a silver-palladium alloy through a screen printing process. Further, the electrodes 24 are disposed at the both end portions of the resistor heating member 23. The electrodes 24 are formed of silver with chemical stability and low electrical resistivity or tungsten with a high melting point.

In the embodiment, when a power source (not shown) applies a voltage to the electrodes 24, the plane heating member 4 heats up (at 800 W, for example). The protective layer 25 is formed on the upper surface of the plane heating member 4. The protective layer 25 is formed of glass or a typical fluorine type resin such as PTFE (polytetrafluoro-ethylene), PFA (perfluoro-alkoxy-alkane), FEP (perfluoroethylene-propene coploymer), and the like.

Figure 10:
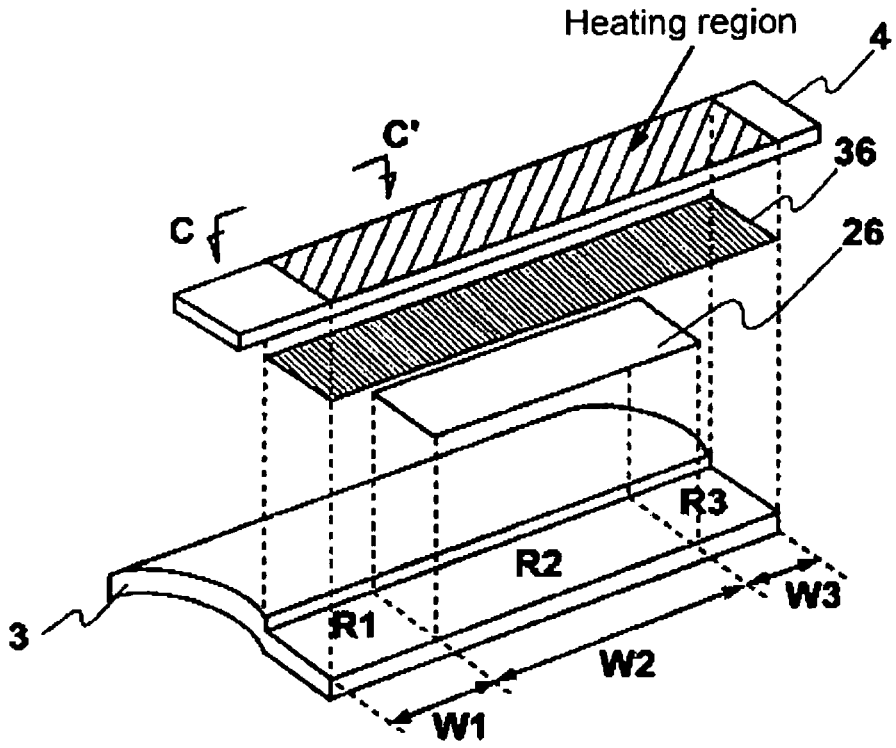
FIG. 10 is a schematic exploded perspective view showing a plane heating member and a supporting member of a fixing device according to a second embodiment of the present invention.

FIG. 10 is a schematic exploded perspective view showing the plane heating member 4 and the supporting member 3 of the fixing device 11 according to the second embodiment of the present invention.

As shown in FIG. 10, the heat conductive portion 36 is formed of grease with high heat resistance such as a silicone type grease or a fluorine type grease, or a resin sheet with high heat resistance such as a silicone resin, polyimide, polyamideimide, a fluorine type resin, and the like. Further, a filler such as carbon black, carbon nanotube, graphite and the like, and powders of a metal such as aluminum or silver or a metal oxide may be mixed in grease to improve heat conductivity. Further, the heat conductive portion 36 may be formed of graphite in a sheet shape, or a metal sheet with a lower melting point made of tin or an alloy containing tin.

As shown in FIG. 3, the heat conductive portion 36 is arranged to fill a small gap between the supporting member 3 and the plane heating member 4. When the heat conductive portion 36 has a sheet shape, it is preferred that the heat conductive portion 36 has a thickness greater than 0.05 mm, thereby improving heat conductivity. Further, it is preferred that the heat conductive portion 36 has a thickness less than 0.5 mm, thereby decreasing thermal resistivity. It is noted that, different from the first embodiment, the heat conductive portion 36 has uniform heat conductivity.

In the embodiment, similar to the heat conductive portion 36, the auxiliary heat conductive portion 26 is formed of grease with high heat resistance such as a silicone type grease or a fluorine type grease, or a resin sheet with high heat resistance such as a silicone resin, polyimide, polyamideimide, a fluorine type resin, and the like. Further, a filler such as carbon black, carbon nanotube, graphite and the like, and powders of a metal such as aluminum or silver or a metal oxide may be mixed in grease to improve heat conductivity. Further, the auxiliary heat conductive portion 26 may be formed of graphite in a sheet shape, a metal sheet with a lower melting point made of tin or an alloy containing tin, or a metal foil of aluminum, copper, or silver.

In the embodiment, it is preferred that the auxiliary heat conductive portion 26 has a thickness less than 0.05 mm, so that the auxiliary heat conductive portion 26 has a thickness smaller than that of the heat conductive portion 36. Further, the auxiliary heat conductive portion 26 has heat conductivity greater than that of the heat conductive portion 36. As shown in FIG. 10, the auxiliary heat conductive portion 26 has a width W2. Accordingly, the supporting member 3 has the widths W1 and W3 at the both end portions thereof, and the widths W1 and W3 are determined according to a temperature distribution of the plane heating member 4.

Figure 11:
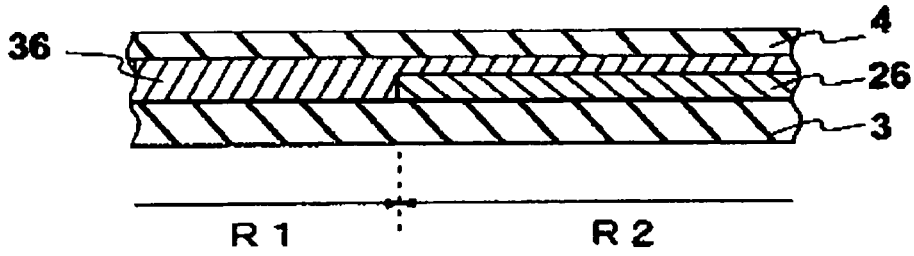
FIG. 11 is a schematic perspective view showing the plane heating member of the fixing device taken along a line C-C' in FIG. 10 according to the second embodiment of the present invention.

FIG. 11 is a schematic perspective view showing the plane heating member 4 of the fixing device 11 taken along a line C-C' in FIG. 10 according to the second embodiment of the present invention. FIG. 11 shows a boundary between the heating region R1 without the auxiliary heat conductive portion 26 and the heating region R2 with the auxiliary heat conductive portion 26. As shown in FIG. 11, the heat conductive portion 36 has a thickness at the heating region R2 smaller than at the heating region R1 by a difference corresponding to the thickness of the auxiliary heat conductive portion 26. In the plane heating member 4, the auxiliary heat conductive portion 26 has heat conductivity greater than that of the heat conductive portion 36, so that it is possible to restrict heat at the both end portions of the heating region from flowing to the supporting member 3 through the heat conductive portion 36.

As shown in FIG. 9(*a*), the fixing belt 2 includes the base member 20*a* formed of a thin member of nickel, stainless steel or polyimide, and the elastic layer 20*b* formed on the base member 20*a* and formed of a silicone rubber or a fluorine type resin.

In the embodiment, the base member 20*a* has a thickness of 30 to 150 μm, so that the base member 20*a* has sufficient strength and flexibility. The elastic layer 20*b* preferably has a thickness of 50 to 300 μm, so that the elastic layer 20*b* has sufficiently low hardness and high heat conductivity. The fixing belt 2 is formed in an endless loop having a width similar to the width of the fixing roller 1. The fixing belt 2 is extended between the fixing roller 1 and the supporting member 3 with a specific tension.

In the embodiment, the fixing belt 2 may have a releasing layer on the elastic layer 20*b*, thereby improving releasing ability relative to the printing medium 8. As shown in FIG. 9(*b*), the fixing belt 2 is modified to have the releasing layer 20*c* on the base member 20*b* without the elastic layer 20*b*. In this case, the fixing belt 2 is extended between the fixing roller 1 and the supporting member 3 such that the releasing layer 20*c* faces outside. Similar to the releasing layer 19 of the fixing roller 1, the releasing layer 20*c* is formed of a typical fluorine type resin with high heat resistance and low surface free energy after molding such as PTFE (polytetrafluoroethylene), PFA (perfluoro-alkoxy-alkane), FEP (perfluoroethylene-propene coploymer), and the like. The releasing layer 20*c* has a thickness of 10 to 50 μm.

In the embodiment, the toner 7 includes a binder resin such as polystyrene, a styrene-propylene copolymer, a styrene-vinyl naphthalene copolymer, a styrene-methyl acrylate copolymer, a polyester type copolymer, a polyurethane type copolymer, an epoxy type copolymer, an aliphatic or cycloaliphatic hydrocarbon resin, an aromatic type petroleum resin, and the like. The binder resin is composed of one type of resin or a mixture of resins. Further, the toner 7 contains a colorant, a releasing agent, and the like. Further, the toner 7 may contain wax such as polyethylene wax, propylene wax, carnauba wax, and various ester type waxes for preventing offset upon fixing.

An operation of the fixing device 11 will be explained next. Similar to the first embodiment, when the transportation unit 16 transports the printing medium 8 with the toner 7 transferred thereto to the fixing device 11, as shown in FIG. 3, the fixing belt 2 of the fixing device 11 follows the movement of the transportation unit 16 and rotates in the arrow direction A at the fixing roller 1 and the pressing roller 5 while sliding against the supporting member 3 and the plane heating member 4. At this moment, the electric power of 800 W is supplied to the plane heating member 4, so that the contact portion of the fixing belt 2 relative to the plane heating member 4 is heated.

In the embodiment, the temperature detection unit (not shown) is provided for detecting the surface temperature of the fixing belt 2. Further, the control unit (not shown) is provided for controlling the electric power supplied to the plane heating member 4 according to the surface temperature of the fixing belt 2. Accordingly, it is possible to maintain the surface temperature of the fixing belt 2 at an optimal temperature (=170° C.) when the printing medium 8 is transported to the fixing device 11.

As described above, the pressing roller 5 is pressed against the fixing roller 1 with the fixing belt 2 in between, thereby forming the nip portion N. When the printing medium 8 with the toner 7 transferred thereto passes through the nip portion N between the fixing belt 2 and the pressing roller 5, the fixing belt 2 and the pressing roller 5 heat and press the toner 7 on the printing medium 8, so that the toner 7 is fixed to the printing medium 8. At this moment, heat generated with the plane heating member 4 flows to the supporting member 3 through the heat conductive portion 36.

As described above, as shown in FIG. 10, the auxiliary heat conductive portion 26 is disposed at the heating region R2 at the middle thereof. Accordingly, heat of the plane heating member 4 easily flows to the supporting member 3 through the heating region R2 as opposed to the heating regions R1 and R3. As a result, it is possible to prevent a temperature at the both end portions of the plane heating member 4 from decreasing, and to uniformly supply heat to the fixing belt 2, thereby preventing a fixing variation spot of the toner 7 on the printing medium 8.

An experiment was conducted for evaluating the fixing device 11 in the second embodiment. In the experiment, the fixing belt 2 had an inner diameter of 45 mm. The fixing belt 2 included the base member 20*a* formed of polyimide and having a thickness of 90 μm; the elastic layer 20*b* formed of a silicone rubber and having a thickness of 200 μm; and the releasing layer 20*c* formed of PFA and having a thickness of 30 μm.

In the experiment, the fixing roller 1 had an outer diameter of 30 mm, and included the elastic layer 18 formed of a silicone sponge and having a thickness of 8 mm. The elastic layer 18 had an ASKER C hardness of 35°. The pressing roller 5 had an outer diameter of 30 mm. The pressing roller 5 included a releasing layer formed of PFA and having a thickness of 30 μm and the elastic layer 28 formed of a silicone sponge and having a thickness of 8 mm. The elastic layer 28 had an ASKER C hardness of 35°. The pressing roller 5 was arranged to press against the fixing roller 1 with a pressing force of 12 kg.f.

In the experiment, the plane heating member 4 was formed of stainless steel, and had a width of 12 mm. The electric power of 800 W was supplied to the plane heating member 4, and the plane heating member 4 was pressed with a pressing force of 1.0 kg.f. The supporting member 3 was formed of aluminum and had a thickness of 1.5 mm. The supporting member 3 and the plane heating member 4 were arranged to contact with the fixing belt 2 with a contact length of 30 mm. The heat conductive portion 36 was formed of PTFE and had a thickness of 0.1 mm.

In the experiment, the heat conductive portion 36 contained 30% of carbon black, and the auxiliary heat conductive portion 26 was formed of an aluminum foil with a thickness of 0.05 mm. The heating regions R1, R2, and R3 had the widths W1 of 30 mm, W2 of 170 mm, and W3 of 30 mm, respectively.

In the experiment, the toner 7 of yellow, magenta, cyan, and black was used. The printing medium 8 had a density of 64 g/m2, and a size of A4. The printing medium 8 was transported laterally, and the toner 7 was transferred to the printing medium 8 at an amount of 1.5±0.1 g. The fixing roller 1 was pressed against the pressing roller 5 to form the nip portion N having a width of 9 mm. The fixing belt 2 rotated at a circumferential speed of 100 mm/s.

In the experiment, under the conditions described above, the toner 7 was transferred and fixed to an entire surface of the printing medium 8. Afterward, the printing medium 8 was visually inspected to detect offset at a lower left edge portion, a lower middle portion, and a lower right edge portion thereof. When offset was visible, the result was represented as NG, and when offset was visible, the result was represented as OK. Results of the experiment are shown in Table 2.

TABLE 2

| Temperature (° C.) | Location | Without heat conductive portion and auxiliary heat conductive portion | With heat conductive portion and auxiliary heat conductive portion |
|---|---|---|---|
| 150 | Lower left | NG | NG |
| | Middle | OK | OK |
| | Lower right | NG | NG |
| 155 | Lower left | NG | NG |
| | Middle | OK | OK |
| | Lower right | NG | NG |
| 160 | Lower left | NG | NG |
| | Middle | OK | OK |
| | Lower right | NG | NG |
| 165 | Lower left | NG | OK |
| | Middle | OK | OK |
| | Lower right | NG | OK |
| 170 | Lower left | OK | OK |
| | Middle | OK | OK |
| | Lower right | OK | OK |
| 175 | Lower left | OK | OK |
| | Middle | OK | OK |
| | Lower right | OK | OK |
| 180 | Lower left | OK | OK |
| | Middle | OK | OK |
| | Lower right | OK | OK |

As shown in Table 2, when the heat conductive portion 36 and the auxiliary heat conductive portion 26 were disposed, the temperature at which offset occurred at the both edge portions of the printing medium 8 decreased by 10° C. Accordingly, it is possible to more uniformly fix the toner 7 to the printing medium 8.

Third Embodiment

A third embodiment of the present invention will be explained next. In the third embodiment, similar to the first embodiment, the printer will be explained as the image forming apparatus. Components in the third embodiment similar to those in the first embodiment are designated with the same reference numerals.

As shown in FIG. 3, the fixing device 11 includes the fixing roller 1, the pressing roller 5 disposed to face the fixing roller 1; and the fixing belt 2 extended between the fixing roller 1 and the supporting member 3. In the fixing device 11, when the transportation unit 16 transports the printing medium 8 with the toner 7 still not fixed, the fixing belt 2 and the pressing roller 5 each rotating sandwich the printing medium 8 to heat and press the printing medium 8, so that the toner 7 is fixed to the printing medium 8.

As shown in FIG. 4(*a*), the fixing roller 1 includes the metal core 17 in a drum shape fitted to the rotational shaft 1*a* and the elastic layer 18 in a drum shape disposed on the outer circumferential surface of the core metal 17. The core metal 17 is formed of a metal pipe of aluminum, iron, stainless steel, and the like having specific rigidity. The elastic layer 18 is formed of a rubber material with high heat resistance such as a silicone rubber or a fluorine rubber.

As shown in FIG. 4(*b*), as the modified example, the releasing layer 19 may be disposed on the elastic layer 18 for easily releasing from the fixing belt 2. The fixing roller 1 is pressed against the pressing roller 5 with the fixing belt 2 extended with the supporting member 3 in between, so that the nip portion N is created between the fixing roller 1 and the pressing roller 5. Further, the fixing roller 1 is arranged to rotate in the arrow direction A (refer to FIG. 3).

As shown in FIG. 5, similar to the fixing roller 1, the pressing roller 5 includes the metal core 27 in a drum shape fitted to the rotational shaft 5*a* and the elastic layer 28 in a drum shape disposed on the outer circumferential surface of the core metal 27. The core metal 27 is formed of a metal pipe of aluminum, iron, stainless steel, and the like having specific rigidity. The elastic layer 28 is normally formed of a rubber material with high heat resistance such as a silicone rubber or a fluorine rubber. The pressing roller 5 is arranged to press against the fixing roller 1 and rotate in the arrow direction B (refer to FIG. 3).

As shown in FIG. 3, the supporting member 3 is arranged to support the fixing belt 2 extended with the fixing roller 1. The supporting member 3 is formed of a metal plate with high heat conductivity and easy processing ability, and is formed in a curved shape along the fixing roller 1 made of aluminum, copper or an alloy thereof, or a metal plate with high heat resistance and high rigidity made of iron, a metal alloy of iron, or stainless steel. The both end portions of the supporting member 3 (in the direction perpendicular to the direction that the fixing belt 2 is extended) are attached and fixed to the housing (not shown) of the fixing device 11.

Figure 12:
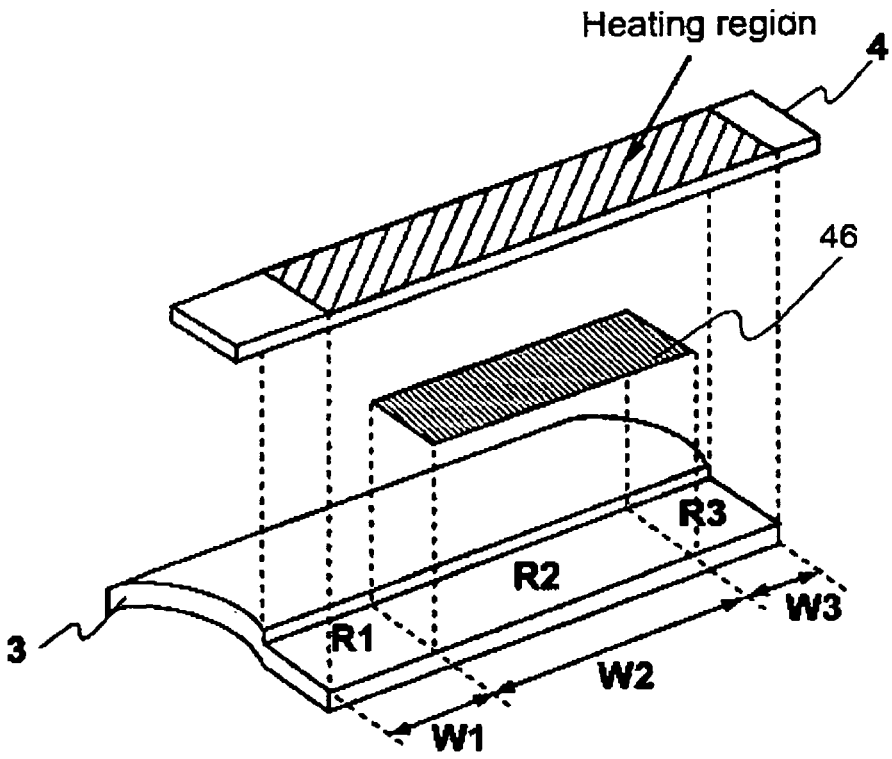
FIG. 12 is a schematic exploded perspective view showing a plane heating member and a supporting member of a fixing device according to a third embodiment of the present invention.

In the embodiment, the plane heating member 4 is disposed in the upper curved surface of the supporting member 3, and a heat conductive portion 46 is disposed under the plane heating member 4 as a heat regulating member (refer to FIG. 12). The supporting member 3 is arranged to closely contact with the plane heating member 4 with the heat conductive portion 46 in between. In particular, the supporting member 3 is integrated with the plane heating member 4 and the heat conductive portion 46 as a supporting portion of the fixing belt 2, so that the fixing belt 2 slides along the upper surface of the supporting member 3 with a specific pressure when the fixing roller 1 rotates.

As shown in FIG. 6(*a*), the plane heating member 4 includes the electrically insulating layer 22 formed of a thin glass layer on the substrate 21 formed of SUS 430 (a ferrite type stainless steel). Further, the resistor heating member 23 is disposed on the electrically insulating layer 22. The resistor heating member 23 is formed of a paste material containing powders of a nickel-chromium alloy or a silver-palladium alloy through a screen printing process. Further, the electrodes 24 are disposed at the both end portions of the resistor heating member 23. The electrodes 24 are formed of silver with chemical stability and low electrical resistivity or tungsten with a high melting point.

In the embodiment, when a power source (not shown) applies a voltage to the electrodes 24, the plane heating member 4 heats up (at 800 W, for example). The protective layer 25 is formed on the upper surface of the plane heating member 4. The protective layer 25 is formed of glass or a typical fluorine type resin such as PTFE (polytetrafluoro-ethylene), PFA (perfluoro-alkoxy-alkane), FEP (perfluoroethylene-propene coploymer), and the like.

FIG. 12 is a schematic exploded perspective view showing the plane heating member 4 and the supporting member 3 of the fixing device 11 according to the third embodiment of the present invention.

As shown in FIG. 12, the heat conductive portion 36 is formed of grease with high heat resistance such as a silicone type grease or a fluorine type grease, or a resin sheet with high heat resistance such as a silicone resin, polyimide, polyamideimide, a fluorine type resin, and the like. Further, a filler such as carbon black, carbon nanotube, graphite and the like, and powders of a metal such as aluminum or silver or a metal oxide may be mixed in grease to improve heat conductivity. Further, the heat conductive portion 36 may be formed of graphite in a sheet shape, or a metal sheet with a lower melting point made of tin or an alloy containing tin.

As shown in FIG. 3, the heat conductive portion 46 is arranged to fill a small gap between the supporting member 3 and the plane heating member 4. When the heat conductive portion 46 has a sheet shape, it is preferred that the heat conductive portion 46 has a thickness greater than 0.05 mm, thereby improving heat conductivity at a middle portion thereof. Further, it is preferred that the heat conductive portion 46 has a thickness less than 0.5 mm, thereby decreasing thermal resistivity.

As shown in FIG. 12, the heat conductive portion 46 is disposed at a location corresponding to the heating region R2 having the width W2. Accordingly, the supporting member 3 has the widths W1 and W3 at the both end portions thereof, and the widths W1 to W3 are determined according to a temperature distribution of the plane heating member 4. Accordingly, heat of the plane heating member 4 easily flows to the supporting member 3 through the heating region R2 as opposed to the heating regions R1 and R3. As a result, it is possible to prevent a temperature at the both end portions of the plane heating member 4 from decreasing, and to uniformly supply heat to the fixing belt 2, thereby preventing a fixing variation spot of the toner 7 on the printing medium 8.

As shown in FIG. 9(*a*), the fixing belt 2 includes the base member 20*a* formed of a thin member of nickel, stainless steel or polyimide, and the elastic layer 20*b* formed on the base member 20*a* and formed of a silicone rubber or a fluorine type resin.

In the embodiment, the base member 20*a* has a thickness of 30 to 150 μm, so that the base member 20*a* has sufficient strength and flexibility. The elastic layer 20*b* preferably has a thickness of 50 to 300 μm, so that the elastic layer 20*b* has sufficiently low hardness and high heat conductivity. The fixing belt 2 is formed in an endless loop having a width similar to the width of the fixing roller 1. The fixing belt 2 is extended between the fixing roller 1 and the supporting member 3 with a specific tension.

In the embodiment, the fixing belt 2 may have a releasing layer on the elastic layer 20*b*, thereby improving releasing ability relative to the printing medium 8. As shown in FIG. 9(*b*), the fixing belt 2 is modified to have the releasing layer 20*c* on the base member 20*b* without the elastic layer 20*b*. In this case, the fixing belt 2 is extended between the fixing roller 1 and the supporting member 3 such that the releasing layer 20*c* faces outside. Similar to the releasing layer 19 of the fixing roller 1, the releasing layer 20*c* is formed of a typical fluorine type resin with high heat resistance and low surface free energy after molding such as PTFE (polytetrafluoroethylene), PFA (perfluoro-alkoxy-alkane), FEP (perfluoroethylene-propene coploymer), and the like. The releasing layer 20*c* has a thickness of 10 to 50 μm.

In the embodiment, the toner 7 includes a binder resin such as polystyrene, a styrene-propylene copolymer, a styrene-vinyl naphthalene copolymer, a styrene-methyl acrylate copolymer, a polyester type copolymer, a polyurethane type copolymer, an epoxy type copolymer, an aliphatic or cycloaliphatic hydrocarbon resin, an aromatic type petroleum resin, and the like. The binder resin is composed of one type of resin or a mixture of resins. Further, the toner 7 contains a colorant, a releasing agent, and the like. Further, the toner 7 may contain wax such as polyethylene wax, propylene wax, carnauba wax, and various ester type waxes for preventing offset upon fixing.

An operation of the fixing device 11 will be explained next. Similar to the first embodiment, when the transportation unit 16 transports the printing medium 8 with the toner 7 transferred thereto to the fixing device 11, as shown in FIG. 3, the fixing belt 2 of the fixing device 11 follows the movement of the transportation unit 16 and rotates in the arrow direction A at the fixing roller 1 and the pressing roller 5 while sliding against the supporting member 3 and the plane heating member 4. At this moment, the electric power of 800 W is supplied to the plane heating member 4, so that the contact portion of the fixing belt 2 relative to the plane heating member 4 is heated.

In the embodiment, the temperature detection unit (not shown) is provided for detecting the surface temperature of the fixing belt 2. Further, the control unit (not shown) is provided for controlling the electric power supplied to the plane heating member 4 according to the surface temperature of the fixing belt 2. Accordingly, it is possible to maintain the surface temperature of the fixing belt 2 at an optimal temperature (=170° C.) when the printing medium 8 is transported to the fixing device 11.

As described above, the pressing roller 5 is pressed against the fixing roller 1 with the fixing belt 2 in between, thereby forming the nip portion N. When the printing medium 8 with the toner 7 transferred thereto passes through the nip portion N between the fixing belt 2 and the pressing roller 5, the fixing belt 2 and the pressing roller 5 heat and press the toner 7 on the printing medium 8, so that the toner 7 is fixed to the printing medium 8. At this moment, heat generated with the plane heating member 4 flows to the supporting member 3 through the heat conductive portion 46.

As described above, as shown in FIG. 12, the heat conductive portion 36 is disposed at the heating region R2 at the middle thereof. Accordingly, heat of the plane heating member 4 easily flows to the supporting member 3 through the heating region R2 as opposed to the heating regions R1 and R3. As a result, heat does not easily flow through the heating regions R1 and R3 as opposed to the middle portion. Accordingly, it is possible to prevent a temperature at the both end portions of the plane heating member 4 from decreasing, and to uniformly supply heat to the fixing belt 2, thereby preventing a fixing variation spot of the toner 7 on the printing medium 8.

As described above, in the embodiments, the effect of the relationship between the heat conductive portion 6 and the plane heating member 4 is explained with respect to the both end portions thereof (in a longitudinal direction). The present invention is not limited thereto, and a similar effect of the relationship between the heat conductive portion 6 and the plane heating member 4 can be obtained in a front-to-rear direction.

Further, in the embodiments, the plane heating member 4 is arranged such that the protective layer 25 contacts with the inner surface of the fixing belt 2. Alternatively, as shown in FIG. 6(*b*), the substrate 21 has the curved surface opposite to the resistor heating member 23 and the protective layer 25. Accordingly, it is possible to arrange the plane heating member 4 such that the inner surface of the fixing belt 2 contacts with the curved surface of the substrate 21.

In the embodiments described above, the printer is explained as the image forming apparatus, and the present invention may be applicable to a copier, a facsimile, and a MFP (Multi Function Product).

The disclosure of Japanese Patent Application No. 2009-266172, filed on Nov. 24, 2009, is incorporated in the application.

While the invention has been explained with reference to the specific embodiments of the invention, the explanation is illustrative and the invention is limited only by the appended claims.

What is claimed is:

1. A fixing device comprising:

a fixing belt for fixing developer to a printing medium;

a supporting member for supporting the fixing belt;

a heating member for heating the fixing belt; and a heat regulating member disposed between the supporting member and the heating member, wherein said heat regulating member includes a center portion and an end portion along a direction perpendicular to a moving direction of the fixing belt, and said center portion has a heat conductivity different from that of the end portion.

2. The fixing device according to claim 1, further comprising an auxiliary heat conductive portion disposed between the heat regulating member and the supporting member.

3. The fixing device according to claim 1, wherein said heat regulating member is sandwiched between the supporting member and the heating member.

4. The fixing device according to claim 3, wherein said supporting member includes a belt contact surface for contacting with an inner surface of the fixing belt, and a heat regulating member contact surface for contacting with the heat regulating member, said belt contacting surface being situated on an upstream side of the heat regulating member contact surface in the moving direction of the fixing belt.

5. The fixing device according to claim 4, wherein said supporting member includes a recess portion for accommodating the heating member and the heat regulating member, said recess portion being situated on a downstream side of the belt contact surface in the moving direction of the fixing belt.

6. The fixing device according to claim 1, wherein said end portion is disposed on both sides of the center portion, said end portion having a heat conductivity lower than that of the center portion.

7. A fixing device comprising:

a fixing belt for fixing developer to a printing medium;

a supporting member for supporting the fixing belt;

a heating member for heating the fixing belt;

a heat regulating member disposed between the supporting member and the heating member; and an auxiliary heat conductive portion disposed between the heat regulating member and the supporting member, wherein said heat regulating member has a heat conductivity lower than that of the auxiliary heat conductive portion.

8. The fixing device according to claim 7, wherein said heat regulating member and said auxiliary heat conductive portion are sandwiched between the supporting member and the heating member.

9. The fixing device according to claim 8, wherein said supporting member includes a belt contact surface for contacting with an inner surface of the fixing belt, and a heat regulating member contact surface for contacting with the heat regulating member, said belt contacting surface being situated on an upstream side of the heat regulating member contact surface in the moving direction of the fixing belt.

10. The fixing device according to claim 9, wherein said supporting member includes a recess portion for accommodating the heating member and the heat regulating member, said recess portion being situated on a downstream side of the belt contact surface in the moving direction of the fixing belt.

11. The fixing device according to claim 7, wherein said heat regulating member includes a center portion and an end portion along a direction perpendicular to a moving direction of the fixing belt, said end portion being disposed on both sides of the center portion, said end portion having a heat conductivity lower than that of the center portion.

12. The fixing device according to claim 7, wherein said heat regulating member has a first thickness and a second thickness along a direction perpendicular to a moving direction of the fixing belt, said first thickness being smaller than the second thickness, said auxiliary heat conductive portion being situated at a portion of the heat regulating member having the first thickness.

13. An image forming apparatus comprising:

a fixing device, wherein said fixing device includes, a fixing belt for fixing developer to a printing medium;

a supporting member for supporting the fixing belt;

a heating member for heating the fixing belt; and a heat regulating member disposed between the supporting member and the heating member, wherein said heat regulating member includes a center portion and an end portion along a direction perpendicular to a moving direction of the fixing belt, and said center portion has a heat conductivity different from that of the end portion.

14. The fixing device according to claim 13, wherein said heat regulating member is sandwiched between the supporting member and the heating member.

15. The fixing device according to claim 14, wherein said supporting member includes a belt contact surface for contacting with an inner surface of the fixing belt, and a heat regulating member contact surface for contacting with the heat regulating member, said belt contacting surface being situated on an upstream side of the heat regulating member contact surface in the moving direction of the fixing belt.

16. The fixing device according to claim 15, wherein said supporting member includes a recess portion for accommodating the heating member and the heat regulating member, said recess portion being situated on a downstream side of the belt contact surface in the moving direction of the fixing belt.

17. The image forming apparatus according to claim 13, further comprising an auxiliary heat conductive portion disposed between the heat regulating member and the supporting member.

18. The fixing device according to claim 13, wherein said end portion is disposed on both sides of the center portion, said end portion having a heat conductivity lower than that of the center portion.

19. An image forming apparatus comprising:

a fixing device, wherein said fixing device includes a fixing belt for fixing developer to a printing medium;

a supporting member for supporting the fixing belt;

a heating member for heating the fixing belt;

a heat regulating member disposed between the supporting member and the heating member; and an auxiliary heat conductive portion disposed between the heat regulating member and the supporting member, wherein said heat regulating member has a heat conductivity lower than that of the auxiliary heat conductive portion.

20. The fixing device according to claim 19, wherein said heat regulating member and said auxiliary heat conductive portion are sandwiched between the supporting member and the heating member.

21. The fixing device according to claim 20, wherein said supporting member includes a belt contact surface for contacting with an inner surface of the fixing belt, and a heat regulating member contact surface for contacting with the heat regulating member, said belt contacting surface being situated on an upstream side of the heat regulating member contact surface in the moving direction of the fixing belt.

22. The fixing device according to claim 21, wherein said supporting member includes a recess portion for accommodating the heating member and the heat regulating member, said recess portion being situated on a downstream side of the belt contact surface in the moving direction of the fixing belt.

23. The fixing device according to claim 19, wherein said heat regulating member includes a center portion and an end portion along a direction perpendicular to a moving direction of the fixing belt, said end portion being disposed on both sides of the center portion, said end portion having a heat conductivity lower than that of the center portion.

24. The fixing device according to claim 19, wherein said heat regulating member has a first thickness and a second thickness along a direction perpendicular to a moving direction of the fixing belt, said first thickness being smaller than the second thickness, said auxiliary heat conductive portion being situated at a portion of the heat regulating member having the first thickness.

* * * * *